US008944514B2

(12) United States Patent
Tadin et al.

(10) Patent No.: US 8,944,514 B2
(45) Date of Patent: Feb. 3, 2015

(54) CHILD SUPPORT DEVICE WITH SEAT INSERT

(75) Inventors: Jeff Tadin, Canton, GA (US); Mark Mendes, Loganville, GA (US); Jessica L. Kostyniak, Roswell, GA (US)

(73) Assignee: Kids II, Inc., Atlanta, GA (US)

( * ) Notice: Subject to any disclaimer, the term of this patent is extended or adjusted under 35 U.S.C. 154(b) by 246 days.

(21) Appl. No.: 13/423,022

(22) Filed: Mar. 16, 2012

(65) Prior Publication Data

US 2012/0261957 A1 Oct. 18, 2012

Related U.S. Application Data

(60) Provisional application No. 61/453,395, filed on Mar. 16, 2011, provisional application No. 61/534,123, filed on Sep. 13, 2011.

(51) Int. Cl.

| | |
|---|---|
| ***A47C 7/00*** | (2006.01) |
| ***A47C 31/00*** | (2006.01) |
| ***A47D 1/00*** | (2006.01) |
| ***A63H 33/00*** | (2006.01) |

(52) U.S. Cl.

CPC ..... *A47D 1/008* (2013.01); *A63H 33/006* (2013.01)

USPC ..... 297/440.11; 297/219.12

(58) Field of Classification Search

USPC ..... 297/5, 487, DIG. 6, 219.12, 440.11, 297/440.22, 440.14, 284.1; 280/87.051; 482/66; 472/15

See application file for complete search history.

(56) References Cited

U.S. PATENT DOCUMENTS

| | | | | | |
|---|---|---|---|---|---|
| 2,765,839 | A | * | 10/1956 | Arpin | 280/87.051 |
| 3,788,699 | A | | 1/1974 | Starr | |
| 4,206,945 | A | * | 6/1980 | Kifferstein | 297/220 |
| 4,695,092 | A | | 9/1987 | Hittie | |
| 4,712,833 | A | | 12/1987 | Swanson | |
| 4,743,063 | A | * | 5/1988 | Foster, Jr. | 297/130 |
| 4,826,208 | A | | 5/1989 | Ozmar | |
| 4,861,109 | A | | 8/1989 | Leach | |

(Continued)

FOREIGN PATENT DOCUMENTS

| | | | |
|---|---|---|---|
| CA | 2717258 | A1 | 12/2006 |
| EP | 0781686 | A2 | 7/1997 |

(Continued)

OTHER PUBLICATIONS

Davis, Kimberly, "Hugga-Bébé," Oct. 26, 2008 to Feb. 8, 2011, Internet Archive <http://web.archive.org/web/20081026100926/http://www.myhuggabebe.com/> 3 pages, Canada.

(Continued)

*Primary Examiner* — Milton Nelson, Jr.
(74) *Attorney, Agent, or Firm* — Alston & Bird LLP

(57) ABSTRACT

Various embodiments of the present invention are directed to a child support device configured for providing an adjustable seating space for a child. According to various embodiments, the child support device includes one or more seat inserts configured for being secured within the child support device's seating space. The seat inserts may be positioned at various locations within the seating space in order to reduce the volume of the seating space and provide additional support for a child seated therein. In various embodiments, the seat inserts are secured to the child support device such that they remain in a fixed, supportive position within the child support device.

33 Claims, 7 Drawing Sheets

(56) References Cited

U.S. PATENT DOCUMENTS

| | | | | |
|---|---|---|---|---|
| 4,871,210 | A | 10/1989 | Alexander et al. | |
| 4,889,388 | A | 12/1989 | Hime | |
| 4,980,397 | A | 12/1990 | Rao et al. | |
| 5,071,192 | A | 12/1991 | Adler | |
| 5,261,134 | A | 11/1993 | Matthews | |
| 5,339,472 | A | 8/1994 | Yin | |
| 5,345,633 | A | 9/1994 | Harnish | |
| 5,433,682 | A | 7/1995 | Fermaglich et al. | |
| 5,519,906 | A | 5/1996 | Fanto-Chan | |
| 5,581,833 | A | 12/1996 | Zenoff | |
| 5,655,817 | A * | 8/1997 | Nienow | 297/465 |
| 5,661,861 | A | 9/1997 | Matthews | |
| 5,676,426 | A * | 10/1997 | Herring | 297/484 |
| 5,732,999 | A | 3/1998 | Petrie | |
| 5,800,020 | A * | 9/1998 | Brock | 297/488 |
| 5,813,066 | A | 9/1998 | Gebhard et al. | |
| 5,826,287 | A | 10/1998 | Tandrup | |
| 5,829,830 | A | 11/1998 | Maloney | |
| 5,916,089 | A | 6/1999 | Ive | |
| 5,930,854 | A | 8/1999 | O'Neill et al. | |
| 5,937,461 | A | 8/1999 | Dombrowski et al. | |
| 6,006,381 | A | 12/1999 | Tandrup | |
| 6,055,687 | A | 5/2000 | Matthews | |
| 6,061,854 | A | 5/2000 | Crowley | |
| 6,079,067 | A | 6/2000 | Becker et al. | |
| 6,079,778 | A * | 6/2000 | Lindberg | 297/223 |
| 6,233,767 | B1 | 5/2001 | Horowitz | |
| D443,461 | S | 6/2001 | Hall et al. | |
| D444,981 | S | 7/2001 | Hall et al. | |
| 6,279,185 | B1 | 8/2001 | Matthews | |
| D447,376 | S | 9/2001 | Kramer | |
| D450,517 | S | 11/2001 | Darling et al. | |
| 6,354,665 | B1 | 3/2002 | Ross | |
| 6,412,128 | B1 | 7/2002 | Matthews | |
| 6,434,770 | B2 | 8/2002 | Matthews Brown | |
| 6,463,608 | B1 | 10/2002 | Moe | |
| 6,467,840 | B1 | 10/2002 | Verbovszky et al. | |
| 6,484,337 | B1 | 11/2002 | Moe et al. | |
| 6,499,165 | B1 | 12/2002 | Morgillo | |
| 6,532,612 | B2 | 3/2003 | Matthews Brown | |
| 6,539,567 | B1 | 4/2003 | Bae | |
| 6,553,590 | B1 | 4/2003 | Leach | |
| 6,574,810 | B2 | 6/2003 | Mangiaracina | |
| 6,626,487 | B1 | 9/2003 | Buitendach | |
| 6,651,282 | B1 | 11/2003 | Skoug et al. | |
| 6,658,681 | B2 | 12/2003 | Britto et al. | |
| 6,752,457 | B2 | 6/2004 | Gold et al. | |
| 6,783,175 | B1 | 8/2004 | Henderson | |
| 6,810,545 | B1 | 11/2004 | Darling et al. | |
| 6,817,864 | B1 | 11/2004 | Martinez | |
| 6,877,176 | B2 | 4/2005 | Houghteling | |
| 6,918,149 | B2 | 7/2005 | Gowaty et al. | |
| 6,918,631 | B2 | 7/2005 | Verbovszky | |
| 7,000,273 | B2 | 2/2006 | Rivera-Wienhold et al. | |
| 7,010,821 | B1 | 3/2006 | Leach | |
| 7,017,212 | B2 | 3/2006 | Matthews Brown | |
| 7,044,547 | B2 | 5/2006 | Sorrenti | |
| 7,070,238 | B1 | 7/2006 | Alexander et al. | |
| 7,097,243 | B2 | 8/2006 | Verbovszky | |
| 7,131,156 | B1 | 11/2006 | Walker-Craft | |
| D550,971 | S | 9/2007 | McConnell | |
| D553,865 | S | 10/2007 | Buitendach | |
| 7,356,861 | B1 | 4/2008 | Pagano | |
| 7,416,257 | B1 | 8/2008 | Lakhman | |
| 7,464,423 | B2 | 12/2008 | Goodwin et al. | |
| 7,513,001 | B1 | 4/2009 | Leach | |
| 7,562,406 | B1 | 7/2009 | Leach | |
| 7,562,938 | B2 | 7/2009 | Lakhman | |
| 7,614,098 | B1 | 11/2009 | Quarry | |
| 7,614,930 | B2 | 11/2009 | Berkey et al. | |
| 7,641,283 | B2 | 1/2010 | Rumack | |
| 7,657,955 | B1 | 2/2010 | Alvistur et al. | |
| 7,740,560 | B2 | 6/2010 | Tadin et al. | |
| 2007/0108810 | A1 | 5/2007 | Nishimoto et al. | |
| 2008/0054696 | A1 | 3/2008 | McConnell et al. | |
| 2009/0015046 | A1 | 1/2009 | McClintock et al. | |
| 2010/0066138 | A1 | 3/2010 | Rumack | |
| 2010/0078976 | A1 | 4/2010 | Hou et al. | |

FOREIGN PATENT DOCUMENTS

| | | | |
|---|---|---|---|
| GB | 2269741 | A | 2/1994 |
| JP | 8242977 | A | 9/1996 |

OTHER PUBLICATIONS

International Searching Authority, International Search Report and Written Opinion for International Application No. PCT/US2012/029532, mailed Jun. 7, 2012, 7 pages, Federal Institute of Industrial Property, Russia.

* cited by examiner

CHILD SUPPORT DEVICE WITH SEAT INSERT

CROSS-REFERENCE TO RELATED APPLICATIONS

This application claims priority from provisional U.S. Application No. 61/453,395 entitled "Child Support Device with Insert," which was filed on Mar. 16, 2011, and from U.S. Provisional Application No. 61/534,123 entitled "Child Support Device with Insert," which was filed on Sep. 13, 2011, the entirety of which are herein incorporated by reference.

BACKGROUND OF THE INVENTION

1. Field of the Invention

Various embodiments of the present invention described herein generally relate to a child support device configured for providing an adjustable seating space for a child.

2. Description of Related Art

Seat inserts are frequently used to adjust the seating volume of child support devices in order to accommodate children of different ages and sizes. For example, loose cushions are often placed in a seating area to provide additional support for smaller children. However, these loose cushions may slide or shift within the seating area and, as a result, can be uncomfortable and may cause a child to have an undesirable posture. Other seat inserts are configured to wrap around a child within the seating area, but provide limited adjustability and can often take up too much volume within a seating area. In addition, such seat inserts may inhibit the movement of a child's arms or upper body. In addition, many seat inserts incorporate complex attachment and/or removal mechanisms that can make it difficult for a parent to secure such inserts within a seating area.

Accordingly, there is a need in the art for an improved child seat insert configured to provide improved support, stability, and comfort for a child, and which is easy for a parent to attach to, or remove from, a child support device.

BRIEF SUMMARY OF THE INVENTION

Various embodiments of the present invention are directed to a child support device configured for providing an adjustable seating space for a child. In various embodiments, the child support device comprises a frame including a seat member at least partially surrounding a seating space for a child, the seat member including one or more fasteners, and a seat insert configured for being removably attached to the seat member in order to reduce the volume of the seating space. In various embodiments, the seat insert includes one or more mating fasteners configured for releasably engaging the seat member's one or more fasteners in order to removably attach the seat insert to the seat member, and, when the seat insert is attached to the seat member, the seat insert is secured in a substantially fixed relationship to the seat member.

In addition, various embodiments of the present invention are directed to a child support device configured for providing an adjustable seating space for a child in which the child support device comprises a frame including a seat member at least partially surrounding a seating space for a child, and at least one pocket operatively connected to the seat member and configured for receiving a void-filling material. In various embodiments, the at least one pocket is positioned relative to the seat member such that, when the void-filling material is disposed within the pocket, the pocket reduces the volume of the seating space.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION OF THE INVENTION

The present invention will now be described more fully hereinafter with reference to the accompanying drawings, in which some, but not all embodiments of the invention are shown. Indeed, the invention may be embodied in many different forms and should not be construed as limited to the embodiments set forth herein. Rather, these embodiments are provided so that this disclosure will satisfy applicable legal requirements. Like numbers refer to like elements throughout.

Overview

Various embodiments of the present invention are directed to a child support device configured for providing an adjustable seating space for a child. According to various embodiments, the child support device generally includes one or more seat inserts configured for being secured within the child support device's seating space. The seat inserts may be positioned at various locations within the seating space in order to reduce the volume of the seating space and provide additional support for a child seated therein. The seat inserts may be used, for example, to adjust the seating space in order to securely and comfortably accommodate children of different sizes.

As described in greater detail below, various embodiments of the child seat inserts described herein may be positioned in a frontal portion of the seating space to provide abdominal support for a child, and/or in a rearward portion of the seating space to provide back support for a child. To ensure stable and consistent support, various embodiments of the child seat inserts are configured for being securely attached to the child support device with fasteners or for being disposed within pockets provided in the seating space. In addition, the various attachment devices and methods described herein enable a user (e.g., a parent) to easily attach the seat inserts to, or remove the seat inserts from, the child support device.

According to various embodiments, the seat inserts described herein may be adapted for use with a variety of child support devices, including children's jumpers, entertainers, bouncers, high chairs, swing seats, and other children's devices having a seating space for a child. Although specific embodiments are described below, it will be appreciated that the various features described herein may be adapted for use with any suitable child support device.

Child Support Device with Seat Insert

Figure 1:
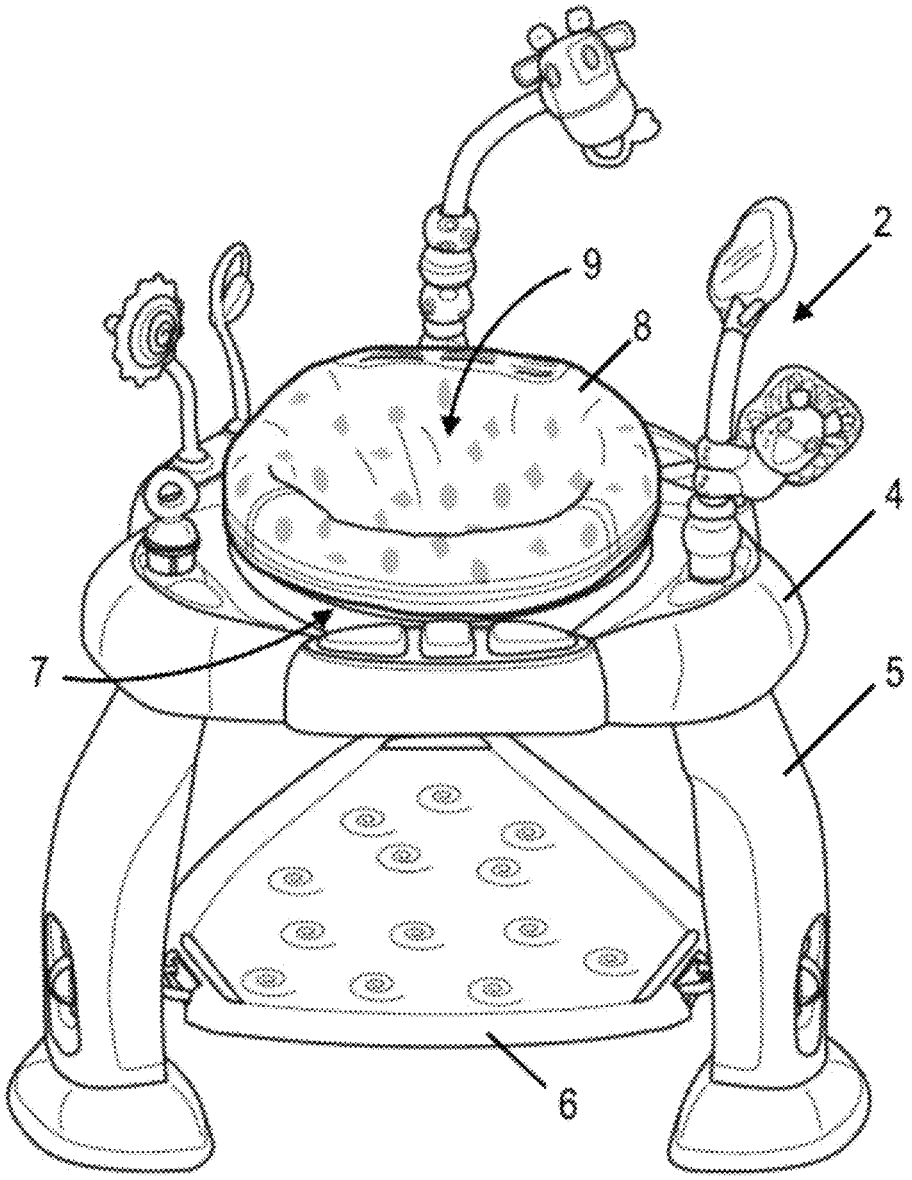
FIG. 1 shows a perspective view of a child support device according to one embodiment of the present invention.

FIG. 1 illustrates a child support device 2 according to one embodiment of the present invention. In the illustrated embodiment, the child support device 2 is configured as a stationary child exercise apparatus and includes a frame 4 with legs 5, a suspended platform 6, a seat member 7, and a removable sling 8. As shown in FIG. 1, the seat member 7 is operatively connected to the frame 4 such that the frame 4 and legs 5 suspend the seat member 7 above the platform 6. As described in greater detail herein, the removable sling 8 is attached to the seat member 7 and hangs downwardly from the frame 4 to provide a seating surface for a child. The interior area bounded by the seat member 7 and sling 8 generally defines a seating space 9 for a child.

Figure 2:
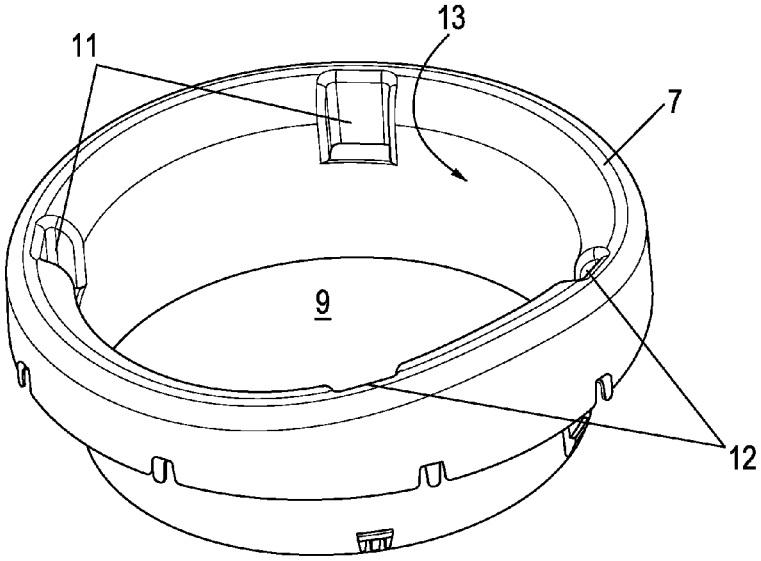
FIG. 2 shows a perspective view of a seat member according to one embodiment of the present invention.

According to various embodiments, the seat member 7 is adapted for receiving one or more seat inserts in order to adjust the volume of the seating space 9. FIG. 2 illustrates the seat member 7 according to one embodiment. In the illustrated embodiment, the seat member 7 is a generally rigid, ring-shaped member having an inner surface 13. As shown in FIG. 2, the area within the seat member's inner surface 13 comprises the seating space 9.

The seat member 7 includes a pair of front slots 11 defined on a frontal portion of the seat member 7 and a pair of rear slots 12 defined on a rearward portion of the seat member 7. Each of the slots 11, 12 generally comprises a recessed portion of the seat member's inner surface 13 and is configured to function as a fastener by being dimensioned to receive a portion of a seat insert. As will be appreciated from the description herein, the seat member 7 may be formed from molded plastic or any other material of suitable strength and rigidity, and may be operatively connected to the frame 4 (e.g., by one or more fasteners). In other embodiments, the seat member 7 may be defined as part of the frame 4 (e.g., where the frame 4 and seat member 7 are formed from a single molded part).

Figure 3:
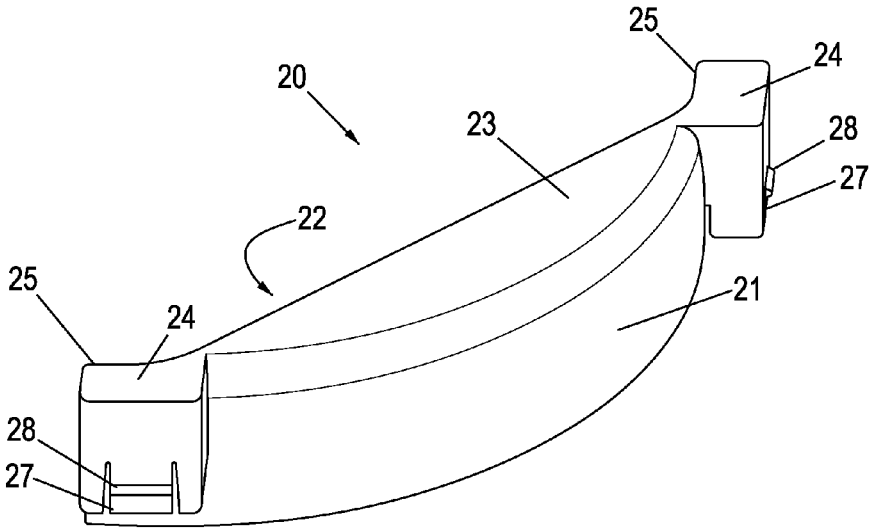
FIG. 3 shows a perspective view of a seat insert according to one embodiment of the present invention.

FIG. 3 illustrates a seat insert 20 configured for being secured to the seat member 7 in order to selectively reduce the volume of the seating space 9. In the illustrated embodiment, the seat insert 20 comprises a generally rigid member defining an outer sidewall 21, an inner sidewall 22, and a top surface 23. The seat insert 20 further defines a pair of protrusions 24 located on the lateral sides of the seat insert 20. As shown in FIG. 3, the seat insert's outer sidewall 21 is convexly curved between the protrusions 24, while the inner sidewall 22 is generally flat. However, the inner sidewall 22 is curved inwardly proximate its lateral edges 25 such that lateral portions of the inner sidewall 22 have a concave curvature. In certain embodiments, the lateral edges 25 of the inner sidewall 22 may be rounded in order to provide a comfortable surface for a child positioned in the seating space 9.

As shown in FIG. 3, each of the seat insert's protrusions 24 includes an outer resilient member 27 having a ridge 28. As described in greater detail below, each protrusion's resilient member 27 is configured to resiliently deflect and engage one of the seat member's slots 11, 12 when the seat insert 20 is attached to the seat member 7. As will be appreciated from the description herein, the seat insert 20 may be formed, for example, from molded plastic.

Figure 4:
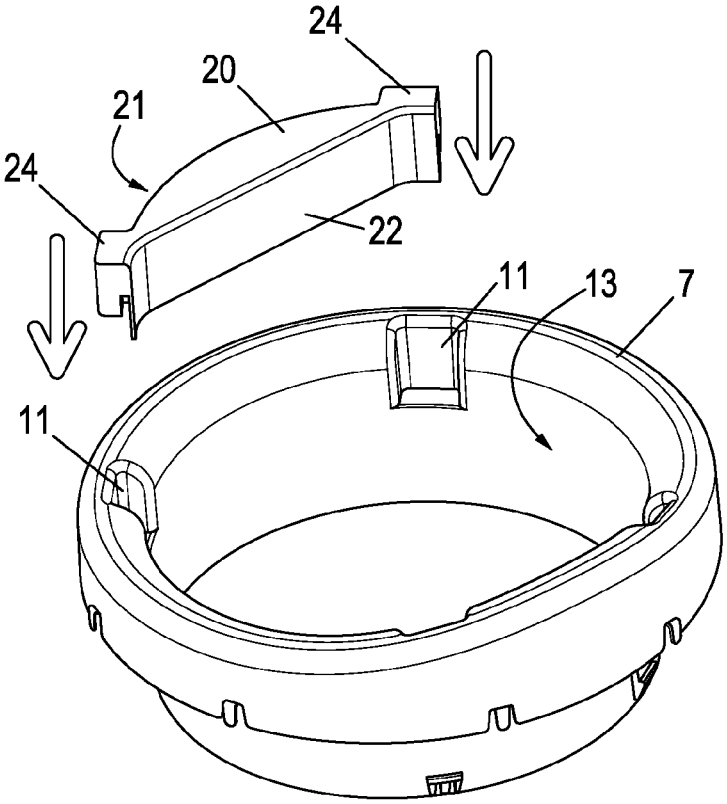
FIG. 4 shows a seat insert protrusion inserted into a seat member slot according to one embodiment of the present invention.

FIGS. 4-8 show a method for attaching the seat insert 20 to the seat member 7 in order to adjust the child support device's seating space 9 according to one embodiment. As shown in FIG. 4, the seat insert 20 is first positioned above the seat member 7 with its outer sidewall 21 facing the inner surface 13 of the seat member 7, its inner sidewall 22 facing the seating space 9, and each of its protrusions 24 aligned with one of the front slots 11. The seat insert 20 is then lowered such that each of the protrusions 24 is inserted into a respective slot 11. As a respective protrusion 24 is inserted into a slot 11, the slot 11 engages the protrusion's ridge 28 and causes the protrusion's resilient member 27 to deflect inwardly. When the protrusion 24 is fully inserted into the slot 11, the resilient member's ridge 28 moves beneath a lower edge of the slot 11 and the resilient member 27 deflects back outwardly to engage the slot 11.

Figure 5:
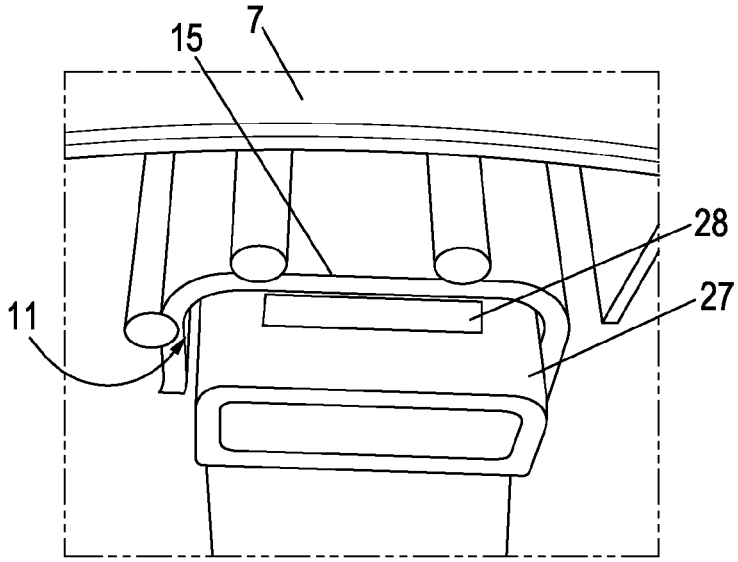
FIG. 5 shows a seat insert disengaged from a seat member according to one embodiment of the present invention.

FIG. 5 shows a lower portion of a resilient member 27 fully engaged with a slot 11. As shown in FIG. 5, the resilient member's ridge 28 is positioned just beneath, and engaged with, the lower edge 15 of the slot 11. Thus, when a respective protrusion 24 is fully inserted into a slot 11, the ridge 28 prevents the seat insert 20 from being lifted upwardly and secures the seat insert 20 to the seat member 7. To remove the seat insert 20 from the seat member 7, a user may press any engaged resilient members 27 inwardly to disengage their respective ridges 28 from the lower edges 15 of the slots 11 and lift the seat insert 20 upwardly. This procedure for attaching and removing the seat insert 20 can be repeated to move and attach the seat insert 20 to the rear slots 12, or to attach an additional seat insert 20 to the rear slots 12. In certain embodiments, the user may pull the seat insert 20 upwards with sufficient force to cause the resilient members 27 to deflect and release the seat insert 20. Additionally, in certain embodiments, the lower edge of each ridge 28 may be angled such that the protrusions 24 can be easily engaged with the slots 11. In such embodiments, the force required to remove the seat insert 20 from the seat member 7 would be greater than the force required to attach the seat insert 20 to the seat member 7, thereby necessitating a more deliberate action to remove the seat insert 20.

As will be appreciated from the description herein, the slots 11, 12, protrusions 24, resilient members 27, and ridges 28 are together configured to function as fasteners for removably attaching the seat insert 20 to the seat member 7. However, according to various other embodiments, a variety of different fastening devices may be adapted for securing the seat insert 20 to the seat member 7 (e.g., snaps, magnets, clamps).

Figure 6:
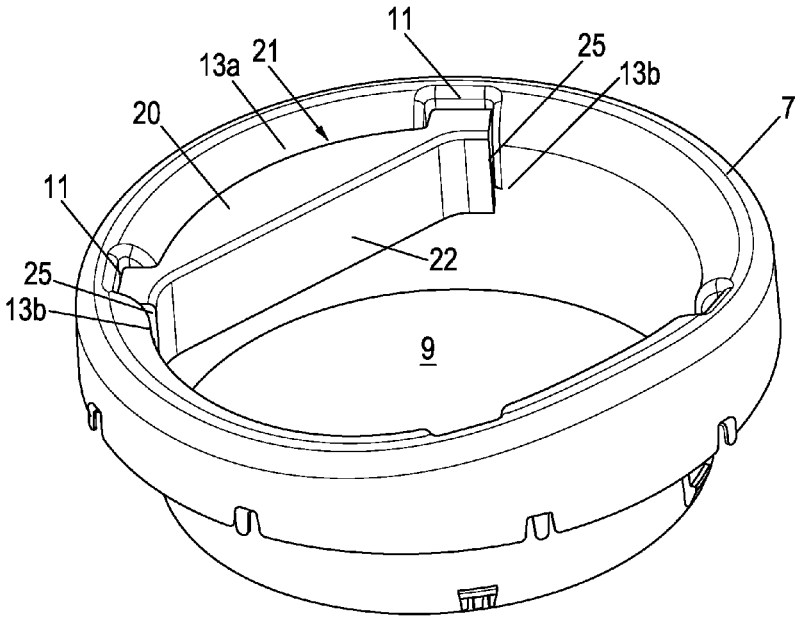
FIG. 6 shows a seat insert engaged with a seat member according to one embodiment of the present invention.

FIG. 6 shows a perspective view of the seat insert 20 attached to the seat member 7. As shown in FIG. 6, the seat insert 20 is shaped to fit securely and integrally with the seat member 7. For example, in the illustrated embodiment, the seat insert's protrusions 24 are closely surrounded by the inner walls of the slots 11. In combination with the engagement of the resilient members 27, the positioning of the protrusions 24 within the slots 11 prevents the seat insert 20 from being moved laterally, forwards, or backwards. Thus, the seat insert 20 is maintained in a substantially fixed relationship to the seat member 7.

In addition, as shown in FIG. 6, the outer sidewall 21 of the seat insert 20 is contoured to match the curvature of the inner surface portion 13*a* adjacent the outer sidewall 21. In certain embodiments, the seat insert 20 is also dimensioned such that the lateral edges 25 of the inner sidewall 22 are substantially aligned with the inner surface portions 13*b* adjacent each lateral edge 25. In other words, the lateral edges 25 are not recessed within the slots 11 or protruding outwardly from the slots 11 such that an uneven intersection with the inner surface 13 exists. Rather, the lateral edge 25 is substantially aligned with the inner surface 13 in order to provide a smooth, comfortable surface for a child.

In the illustrated embodiment of FIG. 6, the seat insert 20 is secured to the front slots 11 such that it occupies a frontal portion of the seating space 9. In this frontal position, the seat insert 20 may function to support the abdomen of a child positioned in the seating space 9, thereby holding the child upright and preventing the child from leaning too far forward. Similarly, the seat insert 20 may be secured to the rear slots 12 such that it occupies a rearward position of the seating space 9. In this rearward position, the seat insert 20 may function to support the back of a child positioned in the seating space 9 and prevent a child form leaning too far back. Accordingly, in order to accommodate children of various sizes, seat inserts 20 may be disposed in either, or both of, the frontal and rearward portions of the seating space 9 in order to provide an optimal seating environment for a particular child and help maintain the child in an upright, seated position. In addition, according to various embodiments, a plurality of seat inserts of differing sizes may be provided to accommodate a child as he or she grows.

Figure 7A:
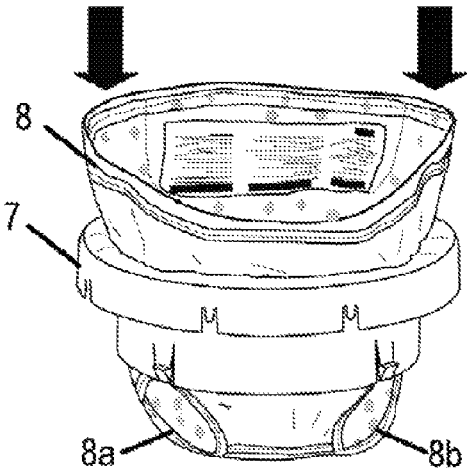
FIG. 7A shows a perspective view of a removable sling being inserted into a seat member according to one embodiment of the present invention.
Figure 7B:
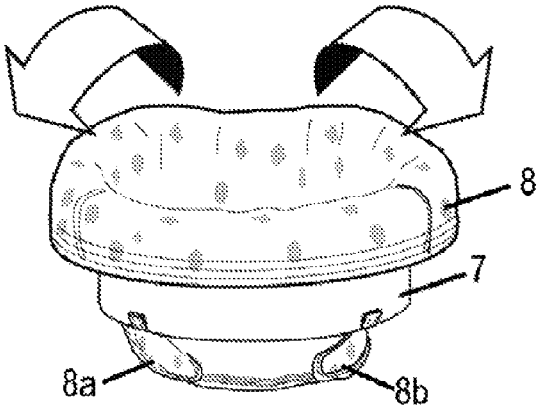
FIG. 7B shows a perspective view of a removable sling being secured to a seat member according to one embodiment of the present invention.
Figure 8:
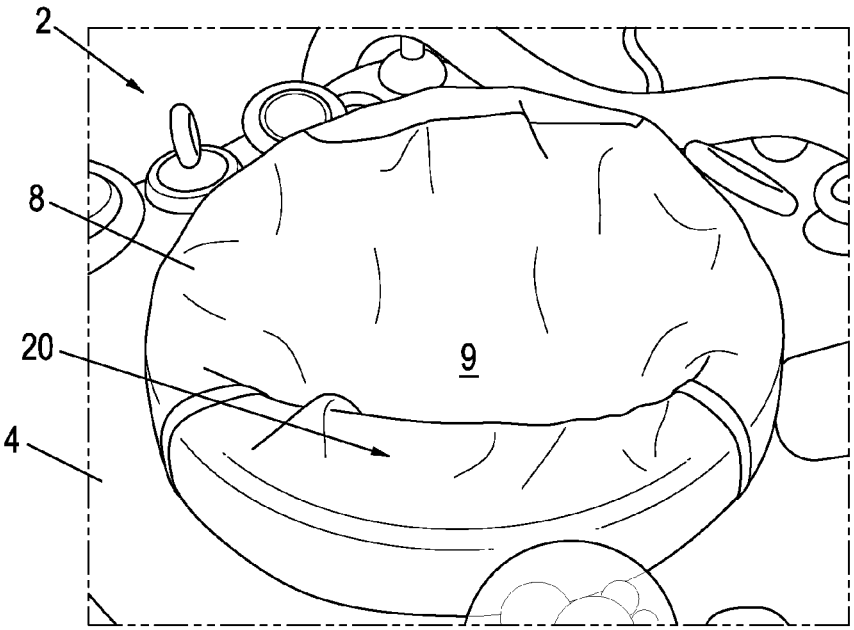
FIG. 8 shows a top view of a child support device according to one embodiment of the present invention.

After attaching the seat insert 20 to the seat member 7, the removable sling 8 may be secured to the seat member 7 as shown in FIGS. 7A and 7B. In the illustrated embodiment, the removable sling 8 comprises a fabric sheet defining a pair of leg openings 8*a*, 8*b*. As shown in FIGS. 7A and 7B, the sling 8 can be lowered into the center of the seat member 7, folded over the edge of the seat member 7 such that it covers the seat insert 20, and secured to the seat member 7 (e.g., by one or more fasteners, clamps, etc). With the sling 8 secured to the seat member 7, the sling 8 will hang downwardly from the frame 4 and define a seating surface configured to support a child positioned in the seating space 9. FIG. 8 shows a top view of the child support device 2 with the sling 8 secured to the frame 4 and the position of the seat insert 20 indicated by an arrow. As is evident from FIG. 8, the seat insert 20 reduces the volume of the seating space 9 within the sling 8.

As will be appreciated from the description provided herein, various modifications to the child support device 2 may be made within the scope of the present invention. In addition, according to various embodiments, the profile and shape of the seat insert 20 and seat member 7 may differ in order to be adapted to child support devices having seating areas with various shapes and profiles. For example, in certain embodiments, the seat member 7 may only partially surround the seating space 9 (e.g., where the seat member 7 has a crescent shape). In certain embodiments, additional (or less) slots may be provided on the seat member 7 in order to accommodate seat inserts 20 positioned at different locations around the seat member 7. In such embodiments, the profile of the seat inserts 20 may be modified to comfortably support various parts of a child (e.g., lateral seat inserts configured to engage the sides of a child). In a particular embodiment, the seat member 7 defines only the front slots 11 such that the seat insert 20 can only be attached in a frontal position within the seat member 7. In addition, in certain embodiments, the seat member 7 may define a seating surface configured to support a child positioned in the seating space 9 (e.g., as an alternative or in addition to the sling 8). In such embodiments the seat member 7 may comprise, for example, a single molded plastic member defining a child seat in addition to the above-described features.

Figure 9:
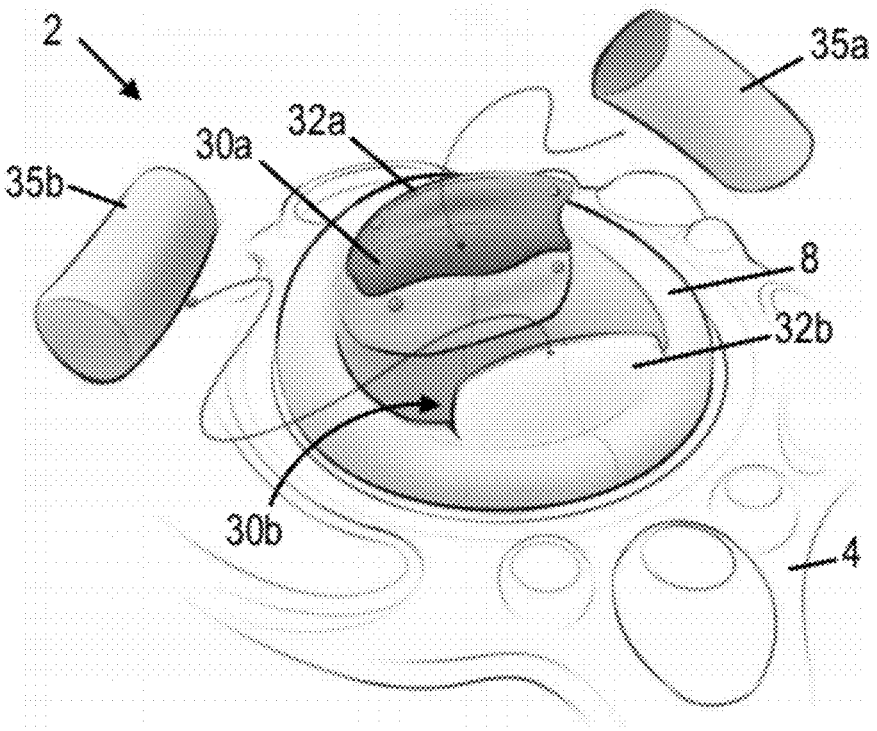
FIG. 9 shows a perspective view of a child support device with pockets configured for receiving cushioning members according to one embodiment of the present invention.
Figure 10:
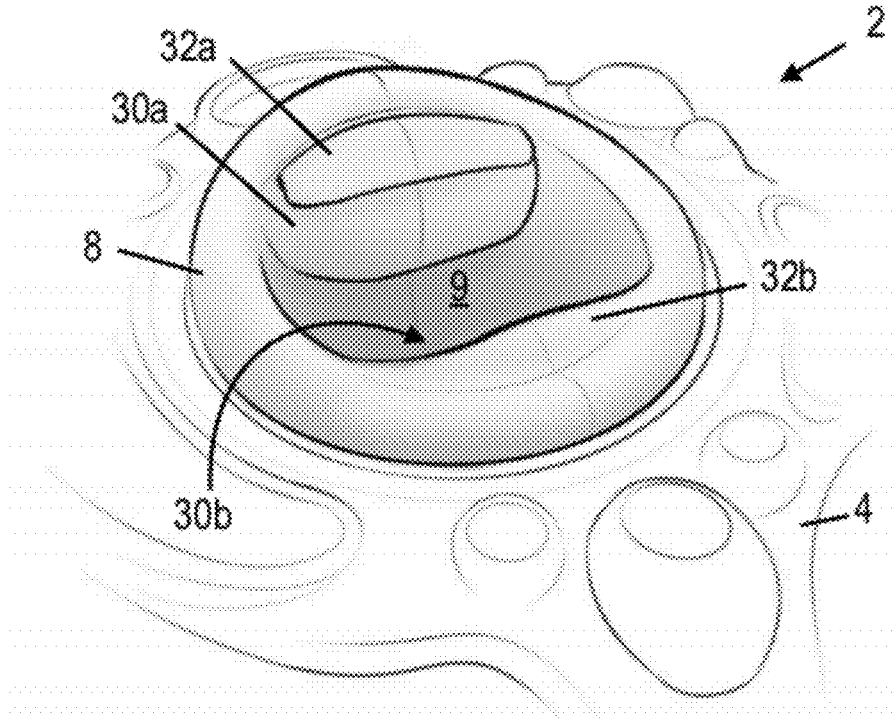
FIG. 10 shows a perspective view of a child support device with pockets containing cushioning members according to one embodiment of the present invention.

In other embodiments, the child support device's seat member 7 and sling 8 may be adapted for receiving other types of seat inserts. For example, FIG. 9 illustrates another embodiment of the child support device 2 in which a pair of pockets 30*a*, 30*b* are disposed on the interior of the sling 8. In the illustrated embodiment, the sling 8 may be secured to the seat member 7 in the manner described above, but without the seat insert 20. As shown in FIGS. 9 and 10, a front pocket 30*a* is disposed on the sling 8 such that it is positioned proximate a frontal area of the seating space 9 and a rear pocket 30*b* is disposed on the sling 8 such that it is positioned proximate a rearward area of the seating space 9. According to various embodiments, the pockets 30*a*, 30*b* may be formed from a flexible material (e.g., nylon fabric) and may be sewn or otherwise attached to the sling 8. In addition, each pocket 30*a*, 30*b* includes a flap 32*a*, 32*b* that can be opened in order to permit access to the pockets 30*a*, 30*b* or closed in order to retain cushioning material disposed therein.

Each of the pockets 30*a*, 30*b* are dimensioned for receiving cushioning members 35*a*, 35*b*. In one embodiment, the cushioning members 35*a*, 35*b* each comprise a flexible outer shell (e.g., formed from a flexible fabric, such as nylon) and an internal fill material (e.g., polyfoam batting). The cushioning members 35*a*, 35*b* are generally configured for providing a comfortable, supportive cushion for a child positioned in the seating space 9. In various other embodiments, the cushioning members may comprise custom-sized pillows or memory foam inserts. However, according to various embodiments, the pockets 30*a*, 30*b* may be filled with any suitable void-filling material or insert capable of fitting in the pockets 30*a*, 30*b*. For example, in various embodiments, substantially rigid inserts (e.g., plastic inserts, rubber inserts) or loose material (e.g., polystyrene beads) may be provided in the pockets 30*a*, 30*b*. In addition, in certain embodiments, the pockets 30*a*, 30*b* may be lined with a padded material.

Figure 11:
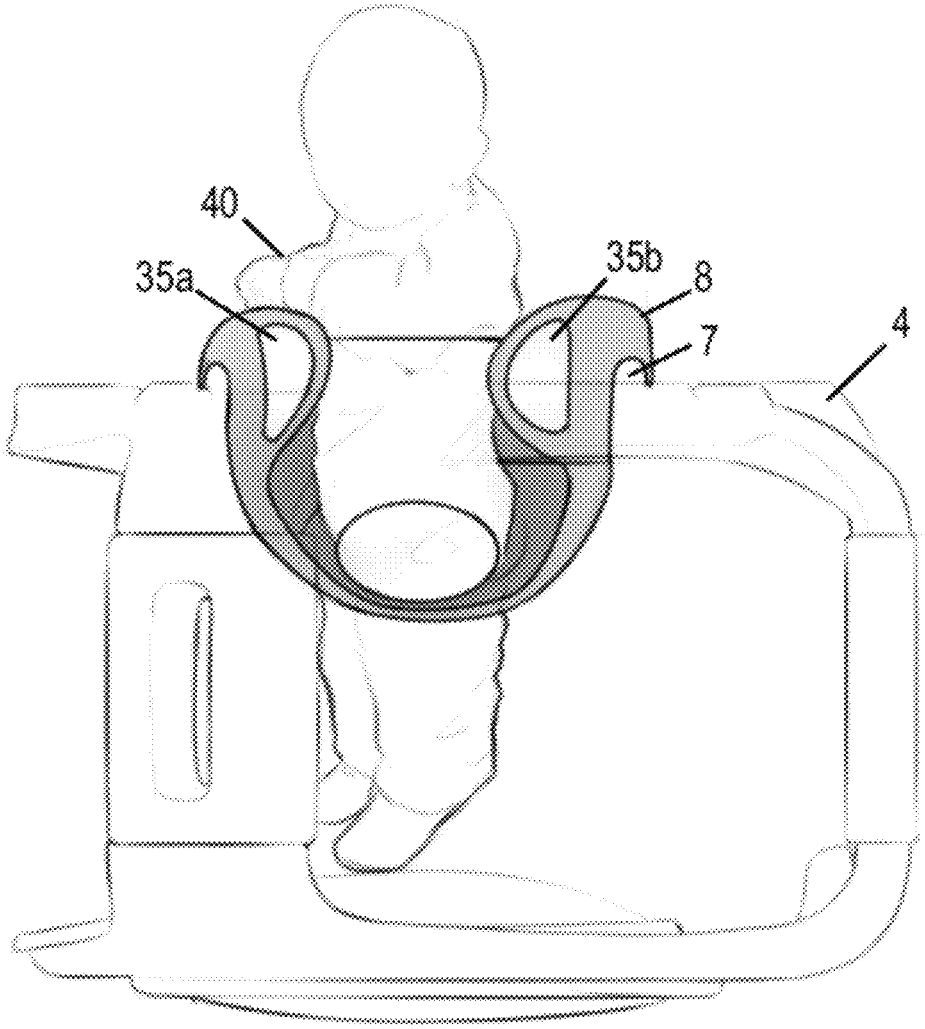
FIG. 11 shows a side elevation view of a child support device and a child seated therein according to one embodiment of the present invention.

FIG. 11 illustrates the pockets 30*a*, 30*b* filled with the cushioning members 35*a*, 35*b* and a child positioned within the sling 8 according to one embodiment. As will be appreciated from FIG. 11, when cushioning material is disposed in the front pocket 30*a*, the front pocket 30*a* occupies a frontal portion of the seating space 9 and is positioned to support the abdomen of a child seated within the seating space 9. Likewise, when cushioning material is disposed in the rear pocket 30*b*, the rear pocket 30*b* occupies a rearward portion of the seating space 9 and is positioned to support the back of a child seated within the seating space 9. By adding or removing the cushioning members 35*a*, 35*b* from one or both of the pockets 30*a*, 30*b*, a user can adjust the volume of the seating space 9 in order to provide an optimal seating environment for a particular child and help maintain the child in an upright, seated position. In addition, according to various embodiments, the pockets 30*a*, 30*b* may be manufactured from a soft material such that—when the pockets 30*a*, 30*b* are not filled with cushioning material—the seating surface provided by the sling 8 remains comfortable.

In other embodiments, the pockets 30*a*, 30*b* may be provided directly on a seating surface connected to the frame 4. For example, in embodiments in which the seat member 7 defines a seating surface configured to support a child positioned in the seating space 9, the pockets 30*a*, 30*b* may be provided directly on the seat member's seating surface. In addition, as will be appreciated from the description provided herein, various modifications to the orientation, shape, material, position, number, and construction of the pockets 30*a*,

30*b* and cushioning material 35*a*, 35*b* may be made within the scope of the present invention.

Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A child support device configured for providing an adjustable seating space for a child, the child support device comprising:

a frame including a seat member at least partially surrounding a seating space for a child, the seat member including one or more fasteners;

a seat insert configured for being removably attached to the seat member in order to reduce the volume of the seating space, wherein the seat insert includes one or more mating fasteners configured for releasably engaging the seat member's one or more fasteners in order to removably attach the seat insert to the seat member, and wherein, when the seat insert is attached to the seat member, the seat insert is secured in a substantially fixed relationship to the seat member; and a removable sling configured for being attached to the seat member to provide a flexible seating surface for a child in the seating space, wherein, when both the seat insert and the removable sling are attached to the seat member, the removable sling hangs downwardly over the seat insert and the seat insert is positioned to reduce the volume of seating space within the removable sling.

2. The child support device of claim 1, wherein each of the seat member's one or more fasteners comprises a slot defined by the seat member; and wherein each of the seat insert's one or more mating fasteners comprises at least one resilient member configured for being inserted into a corresponding slot and engaging the seat member in order to attach the seat insert to the seat member.

3. The child support device of claim 1, wherein the seat member is substantially ring-shaped and configured for receiving the removable sling such that an upper portion of the removable sling hangs downwardly from the seat member when the removable sling is attached to the seat member.

4. The child support device of claim 1, wherein the seat member is operatively connected to the frame by one or more fastening members.

5. The child support device of claim 1, wherein the frame and seat member are formed from a single molded part.

6. The child support device of claim 1, wherein the frame includes one or more legs configured for suspending the seat member above a support surface.

7. The child support device of claim 1, wherein the seat insert comprises a generally rigid member defining at least one inner wall and at least one outer wall; and wherein, when the seat insert is attached to the seat member, the seat insert's outer wall is positioned adjacent the seat member and the seat insert's inner wall faces the seating space.

8. The child support device of claim 7, wherein the seat member and seat insert are configured such that, when the seat insert is attached to the seat member, the seat insert occupies a rearward portion of the seating space and the seat insert's inner wall is positioned to support the back of a child seated in the seating space.

9. The child support device of claim 7, wherein the seat member and seat insert are configured such that, when the seat insert is attached to the seat member, the seat insert occupies a frontal portion of the seating space and the seat insert's inner wall is positioned to support the abdomen of a child seated in the seating space.

10. The child support device of claim 7, wherein the seat member includes an inner surface at least partially defining the seating space; and wherein the seat insert is shaped such that, when the seat insert is attached to the seat member, the lateral edges of the seat insert's inner wall are substantially aligned with portions of the seat member's inner surface adjacent the respective lateral edges.

11. The child support device of claim 10, wherein the seat insert's outer wall is contoured to match the shape of the portion of the seat member's inner surface that is adjacent the seat insert's outer wall when the seat insert is attached to the seat member.

12. The child support device of claim 7, wherein the seat member's one or more fasteners comprise a set of one or more rear fasteners defined on a rearward portion of the seat member and a set of one or more front fasteners defined on a frontal portion of the seat member; and wherein the seat insert's one or more mating fasteners are configured for engaging either of the front fasteners and the rear fasteners, thereby enabling the seat insert to be positioned in a rearward portion of the seating space or a frontal portion of seating space when attached to the seat member.

13. The child support device of claim 12, wherein the seat insert comprises a first seat insert and wherein the child support device further comprises a second seat insert, the second seat insert including one or more mating fasteners configured for engaging either of the front fasteners and the rear fasteners, thereby enabling the second seat insert to be positioned in a portion of the seating space opposite the first seat insert.

14. A child support device configured for providing an adjustable seating space for a child, the child support device comprising:

a frame including a seat member at least partially surrounding a seating space for a child;

a first pocket operatively connected to the seat member and configured for receiving a first void-filling material, wherein the first pocket is positioned relative to the seat member such that, when the first void-filling material is disposed within the first pocket, the first pocket reduces the volume of the seating space; and a second pocket operatively connected to the seat member and configured for receiving a second void-filling material, the second pocket being positioned such that, when the second void-filling material is disposed within the pocket, the pocket occupies a rearward portion of the seating space and is positioned to support the back of a child seated within the seating space.

15. The child support device of claim 14, wherein the first pocket is positioned such that, when the first void-filling material is disposed within the first pocket, the first pocket occupies a frontal portion of the seating space and is positioned to support the abdomen of a child seated within the seating space.

16. The child support device of claim 14, further comprising a removable sling configured for being attached to the seat member to provide a flexible seating surface for a child in the seating space, wherein at least one of the first pocket and the second pocket is defined on the removable sling.

17. The child support device of claim 14, wherein the seat member defines a seating surface configured for supporting a child positioned in the seating space, and wherein at least one of the first pocket and the second pocket is defined on the seat member's seating surface.

18. The child support device of claim 14, wherein at least one of the first and second void-filling material comprises a substantially rigid insert dimensioned for fitting within at least one of the first and second pocket.

19. The child support device of claim 14, wherein the void-filling material comprises a cushioning material.

20. The child support device of claim 19, wherein the cushioning material comprises a cushioning member dimensioned for fitting with the pocket.

21. The child support device of claim 20, wherein the cushioning member includes a flexible outer shell and an internal fill material.

22. A child support device configured for providing an adjustable seating space for a child, the child support device comprising:

a frame including a seat member at least partially surrounding a seating space for a child, the seat member including one or more fasteners; and a seat insert configured for being removably attached to the seat member in order to reduce the volume of the seating space, wherein the seat insert includes one or more mating fasteners configured for releasably engaging the seat member's one or more fasteners in order to removably attach the seat insert to the seat member, and wherein, when the seat insert is attached to the seat member, the seat insert is secured in a substantially fixed relationship to the seat member;

wherein the seat insert comprises a generally rigid member defining at least one inner wall and at least one outer wall;

wherein, when the seat insert is attached to the seat member, the seat insert's outer wall is positioned adjacent the seat member and the seat insert's inner wall faces the seating space;

wherein the seat member's one or more fasteners comprise a set of one or more rear fasteners defined on a rearward portion of the seat member and a set of one or more front fasteners defined on a frontal portion of the seat member; and wherein the seat insert's one or more mating fasteners are configured for engaging either of the front fasteners and the rear fasteners, thereby enabling the seat insert to be positioned in a rearward portion of the seating space or a frontal portion of seating space when attached to the seat member.

23. The child support device of claim 22, wherein the seat insert comprises a first seat insert and wherein the child support device further comprises a second seat insert, the second seat insert including one or more mating fasteners configured for engaging either of the front fasteners and the rear fasteners, thereby enabling the second seat insert to be positioned in a portion of the seating space opposite the first seat insert.

24. The child support device of claim 22, further comprising a removable sling configured for being attached to the seat member to provide a flexible seating surface for a child in the seating space.

25. The child support device of claim 22, wherein the seat member defines a seating surface configured for supporting a child positioned in the seating space.

26. The child support device of claim 22, wherein the seat member includes an inner surface at least partially defining the seating space; and wherein the seat insert is shaped such that, when the seat insert is attached to the seat member, the lateral edges of the seat insert's inner wall are substantially aligned with portions of the seat member's inner surface adjacent the respective lateral edges.

27. The child support device of claim 26, wherein the seat insert's outer wall is contoured to match the shape of the portion of the seat member's inner surface that is adjacent the seat insert's outer wall when the seat insert is attached to the seat member.

28. A child support device configured for providing an adjustable seating space for a child, the child support device comprising:

a frame including a seat member at least partially surrounding a seating space for a child, the seat member including one or more fasteners; and a seat insert configured for being removably attached to the seat member in order to reduce the volume of the seating space, wherein the seat insert includes one or more mating fasteners configured for releasably engaging the seat member's one or more fasteners in order to removably attach the seat insert to the seat member, and wherein, when the seat insert is attached to the seat member, the seat insert is secured in a substantially fixed relationship to the seat member;

wherein each of the seat member's one or more fasteners comprises a slot defined by the seat member; and wherein each of the seat insert's one or more mating fasteners comprises at least one resilient member configured for being inserted into a corresponding slot and engaging the seat member in order to attach the seat insert to the seat member.

29. The child support device of claim 28, wherein the seat insert comprises a generally rigid member defining at least one inner wall and at least one outer wall; and wherein, when the seat insert is attached to the seat member, the seat insert's outer wall is positioned adjacent the seat member and the seat insert's inner wall faces the seating space.

30. The child support device of claim 29, wherein the seat member and seat insert are configured such that, when the seat insert is attached to the seat member, the seat insert occupies a rearward portion of the seating space and the seat insert's inner wall is positioned to support the back of a child seated in the seating space.

31. The child support device of claim 29, wherein the seat member and seat insert are configured such that, when the seat insert is attached to the seat member, the seat insert occupies a frontal portion of the seating space and the seat insert's inner wall is positioned to support the abdomen of a child seated in the seating space.

32. The child support device of claim 29, wherein the seat member includes an inner surface at least partially defining the seating space; and wherein the seat insert is shaped such that, when the seat insert is attached to the seat member, the lateral edges of the seat insert's inner wall are substantially aligned with portions of the seat member's inner surface adjacent the respective lateral edges.

33. The child support device of claim 32, wherein the seat insert's outer wall is contoured to match the shape of the portion of the seat member's inner surface that is adjacent the seat insert's outer wall when the seat insert is attached to the seat member.

* * * * *